US009716329B1

(12) United States Patent
Tien et al.

(10) Patent No.: US 9,716,329 B1
(45) Date of Patent: Jul. 25, 2017

(54) ROTATION ELEMENT AND SAFETY PLUG WITH THE ROTATION ELEMENT

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Li-Wen Tien, New Taipei (TW); Xue-Qing Liu, Shenzhen (CN); Run-Sun Zeng, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/212,296

(22) Filed: Jul. 18, 2016

(30) Foreign Application Priority Data

May 27, 2016 (CN) ..... 2016 1 0360186

(51) Int. Cl.

| | |
|---|---|
| ***H01R 29/00*** | (2006.01) |
| ***H01R 13/44*** | (2006.01) |
| ***H01R 13/60*** | (2006.01) |
| ***H01R 13/08*** | (2006.01) |
| ***H01R 24/28*** | (2011.01) |
| ***H01R 13/502*** | (2006.01) |

(52) U.S. Cl.
CPC ..... *H01R 13/08* (2013.01); *H01R 13/502* (2013.01); *H01R 24/28* (2013.01)

(58) Field of Classification Search
CPC ..... H01R 13/502; H01R 13/08
USPC ..... 439/131, 172
See application file for complete search history.

(56) References Cited

U.S. PATENT DOCUMENTS

| | | | | |
|---|---|---|---|---|
| 5,220,152 | A * | 6/1993 | Doran | E05B 17/0016 219/201 |
| 6,059,584 | A * | 5/2000 | Mareno | H01R 35/04 439/131 |
| 6,312,271 | B1 * | 11/2001 | Tseng | H01R 13/44 439/131 |
| 6,494,727 | B2 * | 12/2002 | Wen-Ching | H01R 35/04 439/131 |
| 6,722,900 | B2 * | 4/2004 | Segawa | H01R 24/28 439/131 |
| 7,628,621 | B2 * | 12/2009 | Tsai | H01R 13/502 439/131 |
| 8,089,244 | B2 * | 1/2012 | Zhang | H01R 24/68 320/107 |

(Continued)

*Primary Examiner* — Briggitte R Hammond
(74) *Attorney, Agent, or Firm* — Steven Reiss

(57) ABSTRACT

A high-safety electrical plug includes a plug body, a rotation element, and at least one plug pin. The rotation element is rotatably arranged on the plug body, and the at least one plug pin is arranged on the rotation element. The rotation element includes an elastic element and a rotation body standing with the elastic element. The rotation body includes two axial cylinders opposite each other and a position limiting element. The two cylinders are formed on the rotation body. The position limiting element defines more than two side surfaces. One side surface connects with the elastic element, deforming the elastic element. The rotation body is rotated until the side surface previously connected with the elastic element is replaced by another side surface to connect with the elastic element, which fixes the rotation body on the elastic element after the rotation.

7 Claims, 6 Drawing Sheets

(56) References Cited

U.S. PATENT DOCUMENTS

| | | | | |
|---|---|---|---|---|
| 9,270,066 | B2 * | 2/2016 | Loh | H01R 24/66 |
| 9,325,098 | B2 * | 4/2016 | Chen | H01R 13/44 |
| 2003/0076070 | A1 * | 4/2003 | Wang | H02J 7/0042 320/111 |
| 2013/0288493 | A1 * | 10/2013 | Shi | H01R 13/44 439/131 |

* cited by examiner

ROTATION ELEMENT AND SAFETY PLUG WITH THE ROTATION ELEMENT

CROSS-REFERENCE TO RELATED APPLICATIONS

This application claims priority to Chinese Patent Application No. 201610360186.0 filed on May 27, 2016, the contents of which are incorporated by reference herein.

FIELD

The subject matter herein generally relates to electrical plugs, and more particular, to a rotation element and a plug with the rotation element.

BACKGROUND

Generally, an electrical plug includes a plug body and at least two or three plug pins. The plug body is made of insulation materials; the plug pins are made of metal materials and stay out of the plug body. It is dangerous for user to touch the plug pins outside of the plug body.

BRIEF DESCRIPTION OF THE DRAWINGS

Implementations of the present technology will now be described, by way of example only, with reference to the attached figures, wherein.

DETAILED DESCRIPTION

Figure 1:
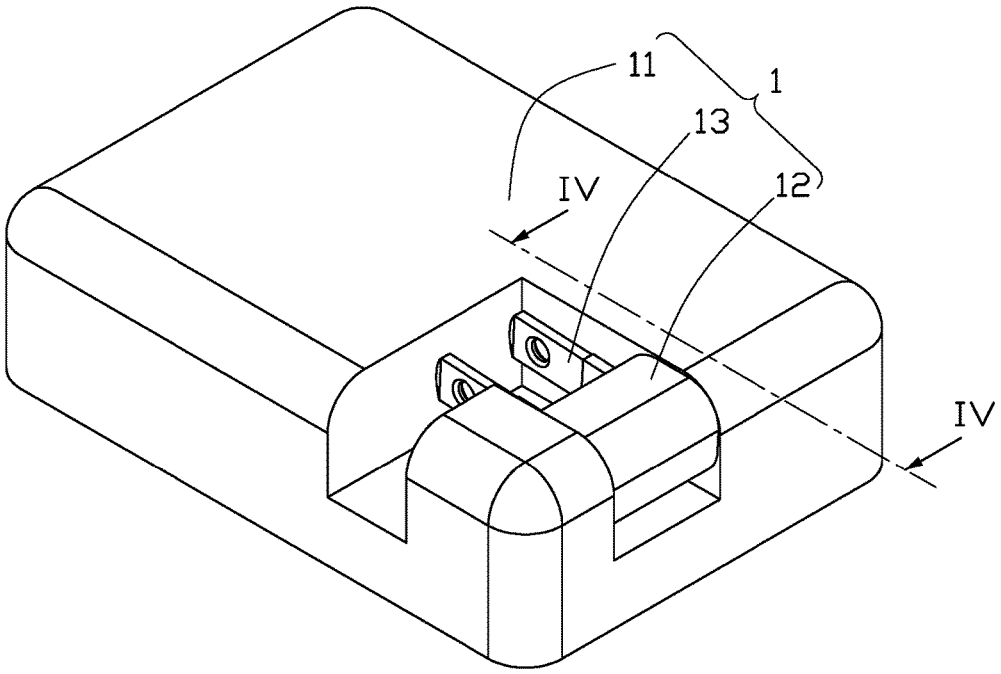
FIG. 1 is a diagrammatic view of one embodiment of an electrical plug.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The present disclosure, including the accompanying drawings, is illustrated by way of examples and not by way of limitation. It should be noted that references to "an" or "one" embodiment in this disclosure are not necessarily to the same embodiment, and such references mean "at least one."

Furthermore, the term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 illustrates an electrical plug 1. The electrical plug 1 includes a plug body 11, a rotation element 12, and at least one plug pin 13. In the embodiment, the plug 1 includes a pair of plug pins 13. In an alternative embodiment, the electrical plug 1 can include three plug pins 13.

Figure 2:
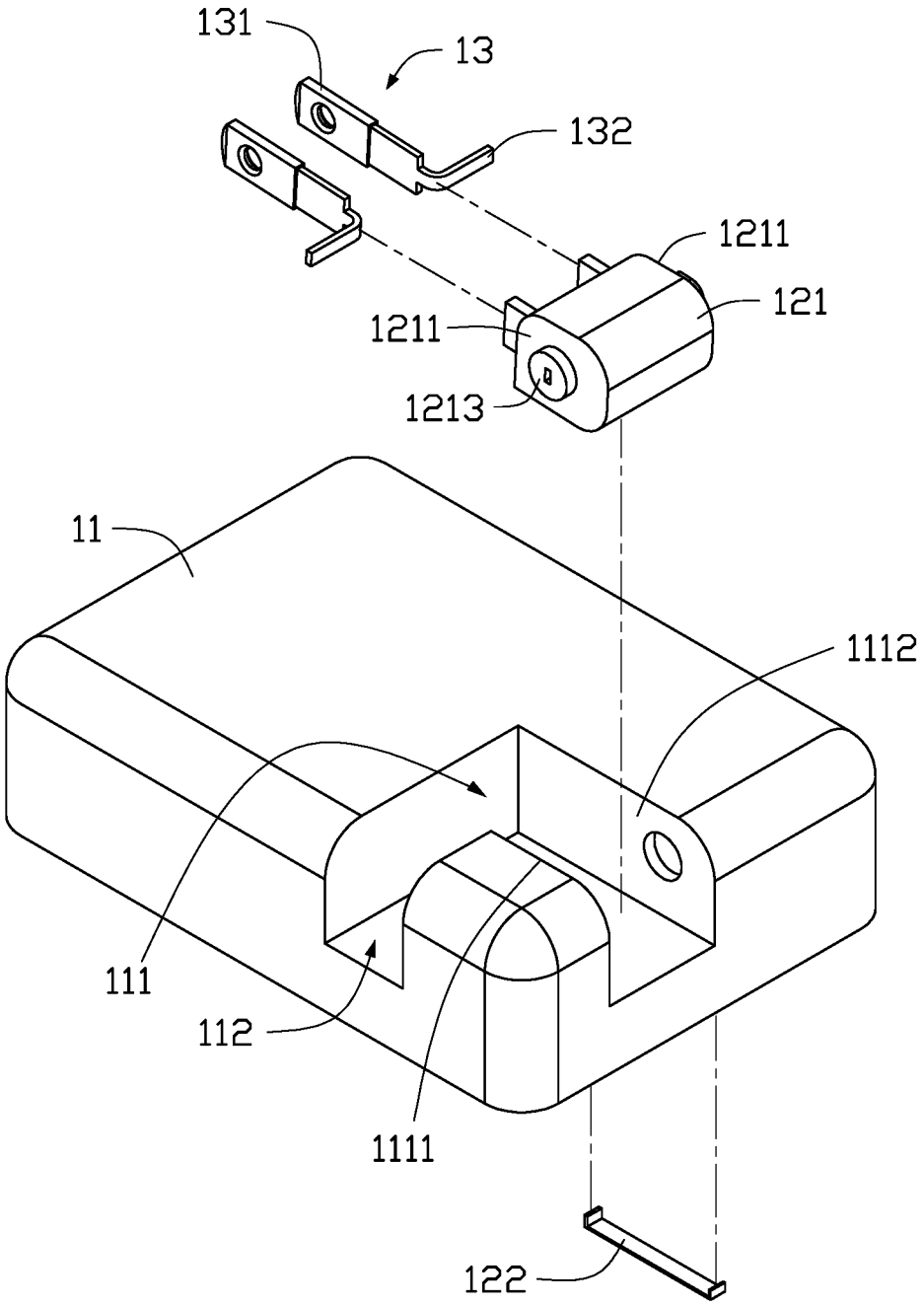
FIG. 2 is an exploded, isometric view of the electrical plug in FIG. 1.

FIG. 2 illustrates an exploded view of the electrical plug 1 in FIG. 1. The rotation element 12 includes a rotation body 121 and an elastic element 122.

The rotation body 121 rotatably couples to the plug body 11. The rotation body 121 defines two axially-arranged cylinders 1213 opposite each other. The rotation body 121 rotatably couples to the plug body 11 through the two cylinders 1213.

The at least one plug pin 13 is arranged on the rotation body 121. While the rotation body 121 rotates around the plug body 11, the at least one plug pin 13 is driven by the rotation body 121 to rotate around the plug body 11 along with the rotation body 121. The rotation element 12 is made of insulation materials, such as rubber. In order to save material, the rotation element 12 can be hollow.

Figure 4:
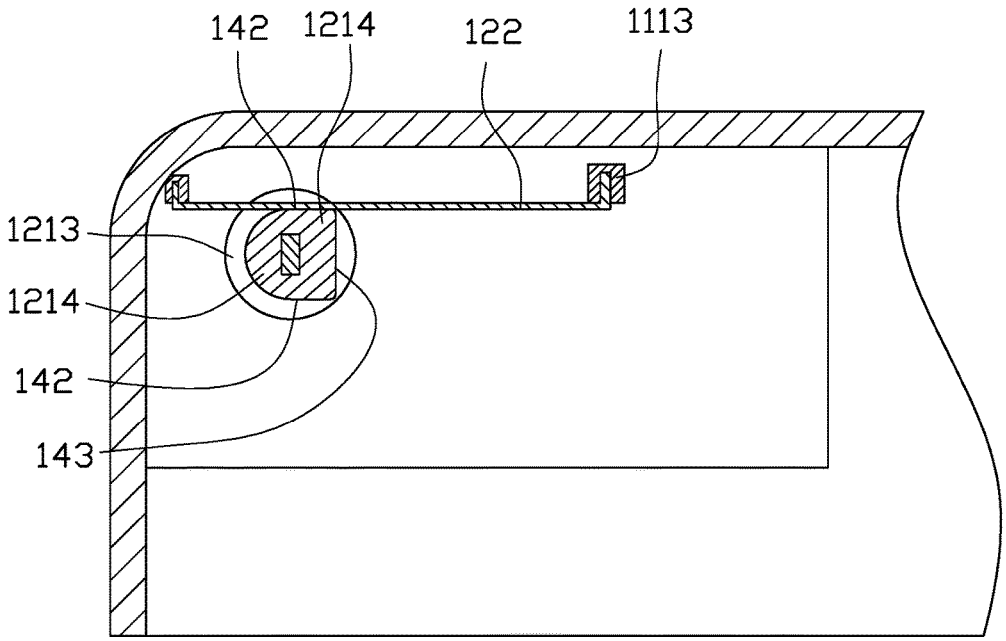
FIG. 4 is a sectioned isometric view of the electrical plug in FIG. 1 along line IV-IV, which shows a position limiting element of a rotation element of the electrical plug connecting with an elastic element of the rotation element in an initial state.

The elastic element 122 is fixedly arranged in the plug body 11 and is perpendicular to a rotation shaft of the rotation body 12 (as shown in FIG. 4). In the embodiment, the elastic element 122 is sheet shaped.

The plug body 11 defines a groove 111 for receiving the plug pins 13 and part of the rotation body 121. In the embodiment, the groove 111 is L shaped. The plug pins 13 can be out of the groove 111 while the rotation body 121 is rotated around the plug body 11.

Figure 3:
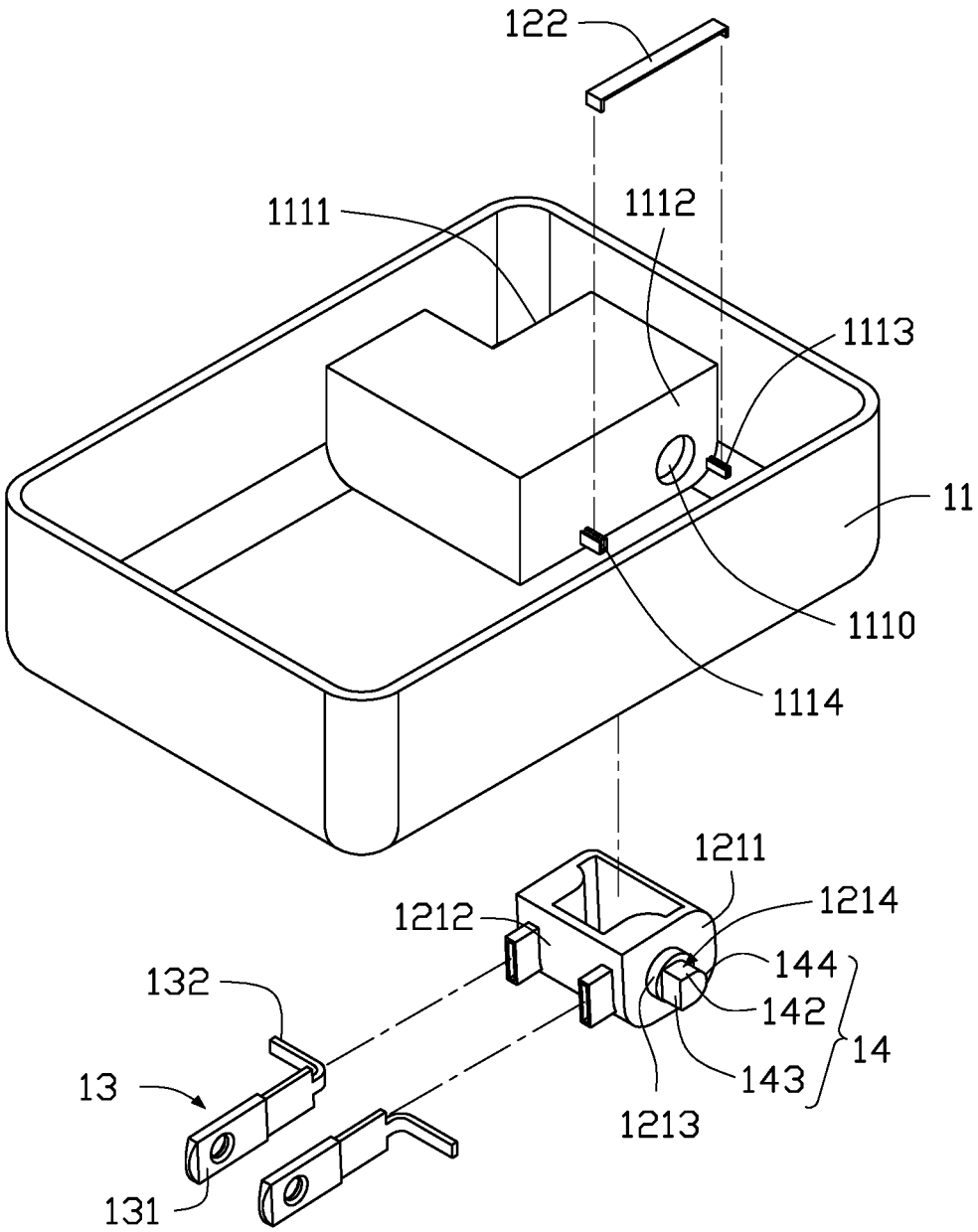
FIG. 3 is an exploded, isometric view of the electrical plug in FIG. 1 from a perspective different.

FIG. 3 illustrates another exploded view of the electrical plug 1. The groove 111 includes a first groove wall 1111 and an opposite second groove wall 1112. Each of the first groove wall 1111 and the second groove wall 1112 defines a through hole 1110 for receiving one cylinder 1213.

The rotation body 121 includes two sidewalls 1211 opposite each other, and at least one connecting wall 1212. The at least one connecting wall 1212 can connect with the two sidewalls 1211. Each cylinder 1213 is formed on a sidewall 1211. A position limiting element 1214 is formed on one of the sidewalls 1211. The position limiting element 1214 is adjacent to the cylinder 1213. That is, the cylinder 1213 is sandwiched between the sidewall 1211 and the position limiting element 1214. The position limiting element 1214 includes more than one side surface 14. Each side surface 14 of the position limiting element 1214 is perpendicular to the cylinder 1213.

In the embodiment, the position limiting element 1214 includes two first side surfaces 142, a second side surface 143, and a third side surface 144. The two first side surfaces 142 are parallel each other. The second side surface 143 connects with the two first side surfaces 142. The third side surface 144 corresponds to the second side surface 143. The third side surface 144 is circular. In the embodiment, the second side surface 143 perpendicularly connects to the two first side surfaces 142.

FIG. 4 shows a sectioned view of the plug 1. The rotation body 121 is rotatably received in the groove 111 while the cylinders 1213 are received in the through holes 1110. The position limiting element 1214 passes through the through holes 1110 and stands with the elastic element 122. That is, one side surface 14 of the position limiting element 1214 connects with the elastic element 122. In the embodiment, the elastic element 122 is arranged above the rotation body 121. In other embodiment, the elastic element 122 can be arranged below the rotation body 121, on the left side or right side of the rotation body 121.

Referring to FIG. 3, the elastic element 122 is fixedly arranged in the plug body 11 through two fixing elements 1113. The two fixing elements 1113 can be arranged in the first groove wall 1111 or the second groove wall 1112. In the embodiment, the two fixing elements 1113 are arranged in the second groove wall 1112. Each of the two fixing element 1113 defines a fixing groove 1114. The fixing groove 1114 is U shaped. Two ends of the elastic element 122 are fixedly received in the two fixing grooves 1114.

Referring to FIG. 4, in an initial state of the rotation body 121 on the elastic element 122, one side surface 14 of the position limiting element 1214 stands with elastic element 122. The rotation body 121 rotates around the plug body 11 until the side surface 14 of the position limiting element 1214 resting on the elastic element 122 is changed. Then, the elastic element 122 is deformed and applies a force to the rotation body 121. The force can prevent the rotation body 121 from being further rotated. Thus, the rotation body 121 is mounted on the elastic element 122.

Figure 5:
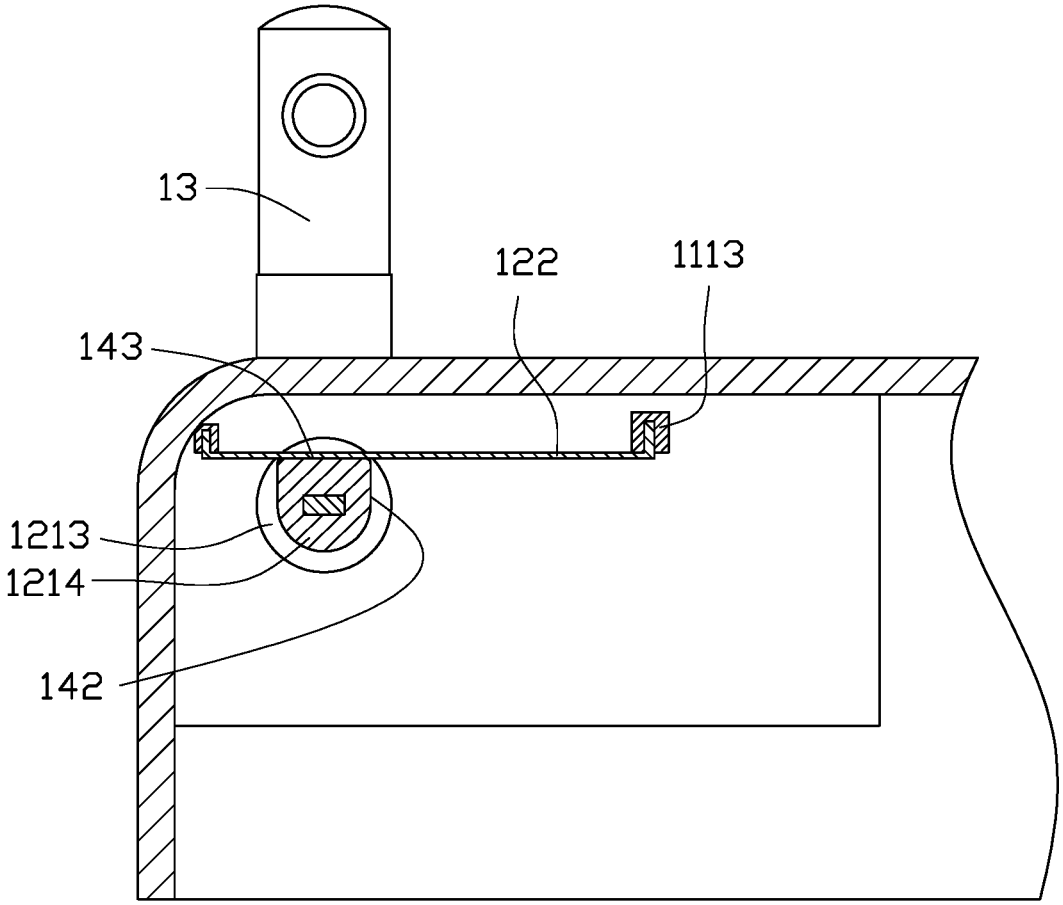
FIG. 5 is a diagrammatic view of the position limiting element connecting with the elastic element of the electrical plug in FIG. 1 in a rotation state.
Figure 6:
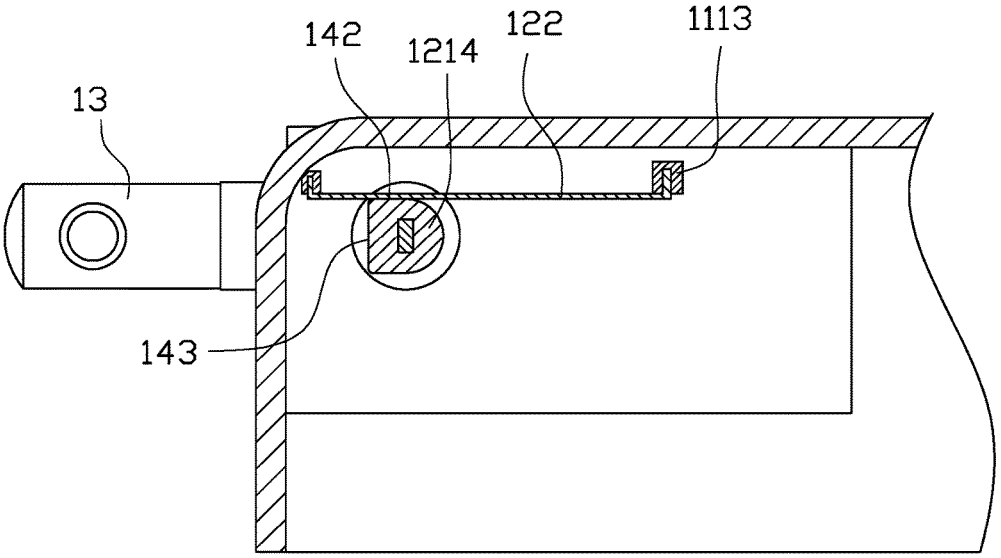
FIG. 6 is a diagrammatic view of the position limiting element connecting with the elastic element of the electrical plug in FIG. 1 in another rotation state.

FIGS. 5-6 illustrate different side surfaces 14 of the position limiting element 1214 connecting with the elastic element 122, in a whole rotation process of the rotation body 121. As shown in FIG. 5, when the rotation body 121 rotates around the plug body 11, the first side surface 142 is driven to rotate around the plug body 11 and along the elastic element 122. When the rotation body 121 rotates about ninety degrees around the plug body 11, the second side surface 143 connects with and stands with the elastic element 122, which also fixes the rotation body 121 on the elastic element 122. As shown in FIG. 6, when the rotation body 121 rotates around the plug body 11, the second side surface 143 is driven to rotate around the plug body 11 and along the elastic element 122. When the rotation body 121 rotates about 180 degrees around the plug body 11, another first side surface 142 connects with and stands with the elastic element 122, which also fixes the rotation body 121 on the elastic element 122. In other embodiment, the position limiting element 1214 can include six or eight side surfaces, which allows the rotation body 121 to rotate to multiple angles around the plug body 11. That is, the position limiting element 1214 can achieve fixed positioning of the rotation body 121 at multiple angles.

Referring to FIG. 2, the plug pins 13 are L shaped. Each plug pin 13 includes a first end 131 and a second end 132. The first end 131 passes through the connecting wall 1212 of the rotation body 121 to plug into a socket (not shown). The second end 132 passes through the cylinder 1213 to connect to an electrically conductive end (not shown) in the plug 1.

Referring to FIG. 1, the plug body 11 further defines an opening 112. The opening 112 connects to the groove 111. Thus, when the plug pins 13 are received in the groove 111, the opening 112 allows a user to apply a force to rotate the plug pins 13.

The embodiments shown and described above are only examples. Many details are often found in the art such as the other features of the rotation element and the electrical plug using the rotation element. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An electrical plug comprising:

a plug body, a rotation element rotatably arranged on the plug body, and at least one plug pin arranged on the rotation element; wherein the rotation element comprises:

an elastic element; and a rotation body resting on the elastic element, the rotation body comprising:

two cylinders opposite to each other and formed on the rotation body; and a position limiting element forming on one of the two cylinders and defining more than two side surfaces, wherein one side surface is connected with the elastic element;

wherein the plug body defines a groove for receiving the rotation body, the groove comprises a first groove wall and a second groove wall opposite each other, wherein the elastic element is fixedly received in the plug body through two fixing elements, the two fixing elements are arranged on the first groove wall or the second groove wall;

wherein the rotation body is rotated until the side surface previously connected with the elastic element is replaced by another side surface to connect with the elastic element, which makes the rotation body fixedly mount on the elastic element.

2. The electrical plug according to claim 1, wherein the position limiting element comprises two first side surfaces and a second side surface, the two first side surfaces are parallel each other, the second side surface connects with the two first side surfaces, the rotation body fixedly mount on the elastic element while one of the two first side surfaces or the second side surface connects with the elastic element.

3. The electrical plug according to claim 1, wherein each of the first groove wall and the second groove wall defines a through hole, the rotation body is rotatably received in the groove while the two cylinders are received in the through holes.

4. The electrical plug according to claim 1, wherein each of the two fixing element defines a fixing groove, two ends of the elastic element are respectively fixedly received in the fixing groove.

5. The electrical plug according to claim 4, wherein the fixing groove is U shaped.

6. The electrical plug according to claim 1, wherein the rotation body comprises two sidewalls opposite each other and at least one connecting wall, the cylinders are respectively formed on a sidewall, the at least one connecting wall connects with the two sidewalls.

7. The electrical plug according to claim 6, wherein the at least plug pin comprises a first end and a second end, the first end passes through the connecting wall to plug into a socket, the second end passes through one cylinder to connect to an electrical conductive end in the plug.

* * * * *